US011320222B2

(12) United States Patent
Nolte

(10) Patent No.: US 11,320,222 B2
(45) Date of Patent: May 3, 2022

(54) CHARGING HANDLE FOR FIREARMS

(71) Applicant: GLOCK TECHNOLOGY GMBH, Ferlach (AT)

(72) Inventor: Patrick Nolte, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/116,148

(22) Filed: Dec. 9, 2020

(65) Prior Publication Data

US 2021/0180895 A1 Jun. 17, 2021

(30) Foreign Application Priority Data

Dec. 17, 2019 (EP) ..... 19216890

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 7/02; F41A 3/72; F41A 35/06
USPC ..... 89/1.4
See application file for complete search history.

(56) References Cited

U.S. PATENT DOCUMENTS 3,225,653 A * 12/1965 Packard ..... F41A 3/72 89/1.4
6,311,603 B1 * 11/2001 Dunlap ..... F41A 3/72 42/2
7,240,600 B1 7/2007 Bordson
7,707,921 B1 * 5/2010 Hoel ..... F41A 3/20 89/1.4
7,832,322 B1 * 11/2010 Hoel ..... F41A 35/06 89/1.4
7,861,635 B1 * 1/2011 Hoel ..... F41A 35/06 89/1.4
7,900,546 B2 * 3/2011 Bordson ..... F41A 35/06 89/1.4
8,336,436 B2 12/2012 Kincel
8,356,537 B2 * 1/2013 Kincel ..... F41A 3/72 89/1.4

(Continued)

OTHER PUBLICATIONS

EPO Search Report for related application EP19216890.4, dated Jun. 11, 2020.

(Continued)

*Primary Examiner* — Jonathan C Weber
(74) *Attorney, Agent, or Firm* — Raven Patents, LLC; Anton E. Skaugset

(57) ABSTRACT

Charging handles for firearms, particularly gas-powered rifles. The disclosed charging handles can be operated on both sides of the firearm and include a shaft having with lateral widening at both sides. The charging handle includes an active handle, a passive handle, and a latch, where the active handle is rotatable about a pin and is urged into a fixing position by at least one spring, such that when the active handle is rotated against the spring force, the latch is released. The passive handle is configured so that when the passive handle is rotated, the passive handle also rotates the active handle. In order to relieve the pin, the release position of the active handle is defined by a support surface on the lateral widening of the shaft. The passive handle is configured analogously.

22 Claims, 6 Drawing Sheets

(56) References Cited

U.S. PATENT DOCUMENTS

| | | | | |
|---|---|---|---|---|
| 8,960,066 | B2 * | 2/2015 | Gomez | F41A 7/00 89/1.4 |
| 9,366,489 | B1 | 6/2016 | Strom | |
| 9,377,258 | B2 | 6/2016 | Gomez | |
| 9,423,195 | B2 | 8/2016 | Daley, Jr. | |
| 9,488,424 | B1 * | 11/2016 | Kincel | F41A 3/72 |
| 9,500,421 | B1 * | 11/2016 | Geissele | F41A 3/72 |
| 9,683,795 | B1 | 6/2017 | Novak | |
| 9,726,445 | B2 * | 8/2017 | Gomez | F41A 35/06 |
| 9,733,030 | B2 * | 8/2017 | Daniel | F41A 3/72 |
| 9,739,549 | B2 * | 8/2017 | Kincel | F41A 3/72 |
| 9,791,225 | B2 | 10/2017 | Seuk | |
| 9,846,003 | B2 * | 12/2017 | Hwang | F41A 3/72 |
| 9,909,826 | B2 * | 3/2018 | Kincel | F41A 35/06 |
| 10,012,461 | B2 | 7/2018 | Curry | |
| 10,161,697 | B1 * | 12/2018 | Underwood | F41A 3/72 |
| 10,337,811 | B1 * | 7/2019 | Underwood | F41A 35/06 |
| 10,451,369 | B1 * | 10/2019 | Hunt | F41A 3/72 |
| 10,697,721 | B2 * | 6/2020 | Kincel | F41A 3/72 |
| 2011/0005117 | A1 * | 1/2011 | Bordson | F41A 3/72 42/69.01 |
| 2011/0174139 | A1 * | 7/2011 | Olsen | F41A 35/06 89/1.4 |
| 2011/0214558 | A1 * | 9/2011 | Kincel | F41A 9/00 89/1.4 |
| 2012/0291612 | A1 * | 11/2012 | Kincel | F41A 3/72 89/1.4 |
| 2014/0060293 | A1 * | 3/2014 | Gomez | F41A 35/06 89/1.4 |
| 2015/0308760 | A1 * | 10/2015 | Gomez | F41A 3/72 89/1.4 |
| 2015/0308761 | A1 * | 10/2015 | McGinty | F41A 35/06 89/1.4 |
| 2016/0061542 | A1 * | 3/2016 | Daley, Jr. | F41A 35/06 89/1.4 |
| 2016/0298917 | A1 * | 10/2016 | Hwang | F41A 3/72 |
| 2016/0320151 | A1 * | 11/2016 | Kincel | F41A 3/72 |
| 2017/0023321 | A1 * | 1/2017 | Kincel | F41A 35/06 |
| 2017/0038170 | A1 * | 2/2017 | Gomez | F41A 7/00 |
| 2020/0011622 | A1 * | 1/2020 | Kincel | F41A 3/72 |
| 2021/0180895 | A1 * | 6/2021 | Nolte | F41A 35/06 |

OTHER PUBLICATIONS

EP Search Report for corresponding EP application No. 19216890.4, dated Jun. 19, 2020.

* cited by examiner

CHARGING HANDLE FOR FIREARMS

TECHNICAL FIELD

The present disclosure relates to charging handles for firearms, and more particularly to charging handles for gas-operated rifles.

BACKGROUND

A charging handle, also known as a cocking handle or bolt handle, is a device on a firearm that is used to pull the bolt towards the rear of the firearm, resulting in the hammer or striker being placed into a spring-loaded cocked configuration. This operation can facilitate the ejection of a spent/unfired cartridge/shell from the chamber, and to load a new round into the chamber from the magazine. Operation of the charging handle can help the operator verify that the chamber is clear of obstructions, or to help clear a jam or misfire, among other malfunctions.

For numerous rifles, in particular those of AR-15-type rifles or M4-type carbines, charging handles have been known as independent parts for many years, and many such charging handles are available on the market to satisfy any of a variety of desires. It should therefore be assumed in the context of the present disclosure that reference to a firearm or a charging handle in connection with that firearm, that the charging handle is adapted for use with that firearm; that the charging handle fits geometrically and functionally into the firearm, so that it can be used with the charging handle according to the present disclosure, and as discussed below:

Charging handles are provided on rifles in order to be able to load the weapon manually; if, for example, there is no cartridge in the chamber and a new magazine has been fitted, the rotary lug bolt is opened by means of the charging handle, and the bolt carrier in which the locking head is mounted is pulled back, whereby the closing spring is tensioned. During the advancing movement, the cartridge is drawn into the chamber and the lock is locked. In the case of automatic shot release, these operations are usually performed by means of the closing spring, which is tensioned each time the cap is moved.

The charging handle should be equally operable for both left-handed and right-handed users. Also, the charging handle should not participate in the movement process of the bolt carrier and the lock after the shot has been fired. On the one hand, this would increase the size of the moving parts and make it necessary to provide stronger springs and thus provide for a stronger force introduction by the gas drive, which in turn would increase the total forces acting, making the weapon as a whole more unsteady, since moving masses are concerned. On the other hand, it would be very irritating, especially with AR-type rifles, if the charging handle were to be moved backwards towards the shooter after each shot. The charging handle should change the outer contour of the weapon as little as possible, and preferably does not have protruding parts, as these can lead to obstructions and problems, especially in terrain.

A number of examples of charging handles are described in the prior art, including the following specific examples.

U.S. Pat. No. 7,240,600 discloses a charging handle which can be actuated from both sides of the firearm, whereby two handles are provided which can be pivoted about vertical axes and which are pushed into their rest position by a pressure spring provided between the two handles. In this rest position, the left handle engages with a hook on the housing of the weapon and thus prevents unintentional movements with the bolt carrier. When the left handle is actuated against the force of the spring, the hook comes out of the recess in the housing and releases the charging handle to move backwards. When actuating the right handle, a fork-like device provided on the right handle takes a projection with it, which engages in the groove between the two forks and thus also brings the left handle into the active position in which the hook does not engage with the housing of the weapon and thus the charging handle can also be activated and used with the right handle. The advantage of this concept is that it requires only a few components, the disadvantage lies in the interaction of groove and projection, which is susceptible to contamination due to the narrow tolerances to be observed and the blind hole-like shape of the groove.

U.S. Pat. No. 8,336,436 discloses a charging handle with a one-piece lever, which optionally can be swiveled to the left or to the right, whereby a spring-loaded mechanism employs appropriate shifters to ensure that when swiveling to any side, the hook comes out of the area of the recess in the housing of the weapon. The mechanism for releasing the hook is complex and relatively delicate and is comprised of a large number of components, which makes it complex and expensive.

U.S. Pat. No. 9,377,258 discloses a charging handle in which two handles each engage with a projection in the groove of a small spring-loaded tube and are thus pressed into the rest position. When one of the two handles is actuated, the other handle is moved along via this small tube and the groove, so that the hook can in either case leave the area of the housing. The almost perfect symmetry makes this solution elegant, but the assembly of the small tube under the handle into the groove is difficult and above all susceptible to contamination.

U.S. Pat. No. 9,683,795 discloses a charging handle with a certain similarity to the aforementioned charging handle of U.S. Pat. No. 7,240,600, excepting that it is even more elaborate and clearly more asymmetrical.

The charging handle of U.S. Pat. No. 9,423,195 employs a completely different approach and only achieves double-sided operability to a very limited extent, because it is necessary to use only a simple existing handle to the left or right by changing the installation direction of the charging handle from a face-down to a back position, which is not an acceptable solution in the field and can only be regarded as "virtually double-sided."

The charging handle of U.S. Pat. No. 9,366,489 is insofar unique in that it does not employ handles but instead mounts a rope, a cord, or the like on the lever, on the one hand, and on the opposite edge area of the charging handle on the other hand, so that the charging handle is actuated by pulling on the cord.

The solution provided by the charging handle of U.S. Pat. No. 9,791,225 is just as exotic, albeit in a different way, in which fixings or connections between the charging handle and the upper body of the rifle are made by means of magnets instead of a pretensioned spring hook, which requires both high temperature-resistant magnets and tight fits, since the closing forces decrease with the square of the distance.

U.S. Pat. No. 10,012,461 discloses a very ingenious charging handle mechanism having two springs, a backplate or cam, and a backplate or cam follower, which makes it possible to operate a one-piece handle either from the left or the right and to get the lever free via the backplate (cam) and the cam follower. This mechanism is however both elaborate and includes numerous components, making it expensive.

The content of the publications of U.S. Pat. Nos. 7,240,600, 8,336,436, 9,377,258, 9,683,795, 9,423,195, 9,366,489 and 10,012,461 is hereby incorporated by reference for any purpose.

Apart from the problems and disadvantages mentioned in each case, all the suggestions mentioned have in common that the actuating forces are usually introduced via the rotary pins (pins, locking pins) of the handles or the handle into the charging handle, which places a heavy mechanical load both on these rotary pins and on their openings in the charging handle, and this also in a thoroughly dynamic, i.e. impacting way.

What is needed is therefore a charging handle for a firearm which does not possess the disadvantages mentioned in the prior art, has relatively fewer components, and is mechanically robust and durable.

SUMMARY

These objectives are achieved by means of a charging handle for a firearm, where the firearm has a housing that includes a latch arrest, and a bolt carrier that includes a gas opening. In one example, the charging handle of the present disclosure includes a shaft having a front portion, a center portion and an end portion; an active handle; and a passive handle. The front portion of the shaft extends into a region of the gas opening of the bolt carrier of the firearm; the end portion of the shaft is widened on both sides in the transverse direction to receive the active handle and the passive handle; and each of the active handle and the passive handle are rotatably mounted on the widened end portion of the shaft by means of a pin. The active handle includes an integrally-formed latch, and is configured so that the active handle can be rotated between a first fixing position and a second release position; where when the active handle is in the first fixing position the latch cooperates with the latch arrest of the firearm housing to fix the charging handle with respect to the firearm housing; and when the active handle is in the second release position the latch does not cooperate with the latch arrest of the firearm housing, an internal stop surface of the active handle abuts a support surface at the widening of the end portion of the shaft; and the charging handle is free to be pulled back with respect to the firearm housing. The passive handle is configured so as to be brought into an operative connection with the active handle; where both handles are urged into the first fixing position of the active handle by at least one spring; provided that the support surface is disposed at a greater distance from a central plane of the firearm than the pin, and a shaft stop for a counter face of the active handle is provided at the end portion of the shaft, the shaft stop being disposed closer to the center plane of the weapon than the pin, and when the active handle is in the second release position, the active handle contacts both the support surface and the stop.

In another example, the active and passive handles have stop surfaces that interact with counter faces on the shaft during operation, thus reducing or eliminating the load on the pins.

In another example, the contact surfaces between the active handle and the passive handle are designed in such a way that a rolling, sliding relative movement occurs when the passive handle is operated, and that the distance between these surfaces increases when the active handle is operated, whereby dirt is largely removed automatically.

Further examples of illustrative charging handles according to the present disclosure provided at the end of the description with exemplary reference to the drawing.

DETAILED DESCRIPTION

Although the charging handles of the present disclosure are primarily disclosed in the context of rifles, including carbines, the term "firearm" as used herein encompasses any firearm, and in particular includes gas-operated firearms that include both handguns and long guns.

As an illustrative example, the charging handles of the present disclosure are described in the context of a charging handle configured for use with an AR-15 rifle. However, the features and advantages of the disclosed charging handles may be used with and applied to any of a variety of other firearms, as would be well-understood by one of skill in the art. In particular, mirror-image designs of the disclosed charging handles in which the locking hook is arranged on the right handle can be readily envisioned and designed by a skilled artisan, and fall within the scope of the present disclosure.

The terms "front," "back," "top," "bottom" and so on are used herein within the context of firearms and common sense, i.e. the muzzle of a rifle is "front," the magazine protrudes "down," and the breech and/or slide is moved to the "rear" by expanding gases. As an example, a Cartesian axis system is provided in FIGS. 2 and 3, in each case, with arrow 51 pointing forward (in the direction of the barrel), arrow 52 pointing to the left, and arrow 53 pointing up. The center plane of the weapon is defined by the plane that intersects the barrel axis and extends parallel to arrow 53.

Figure 1:
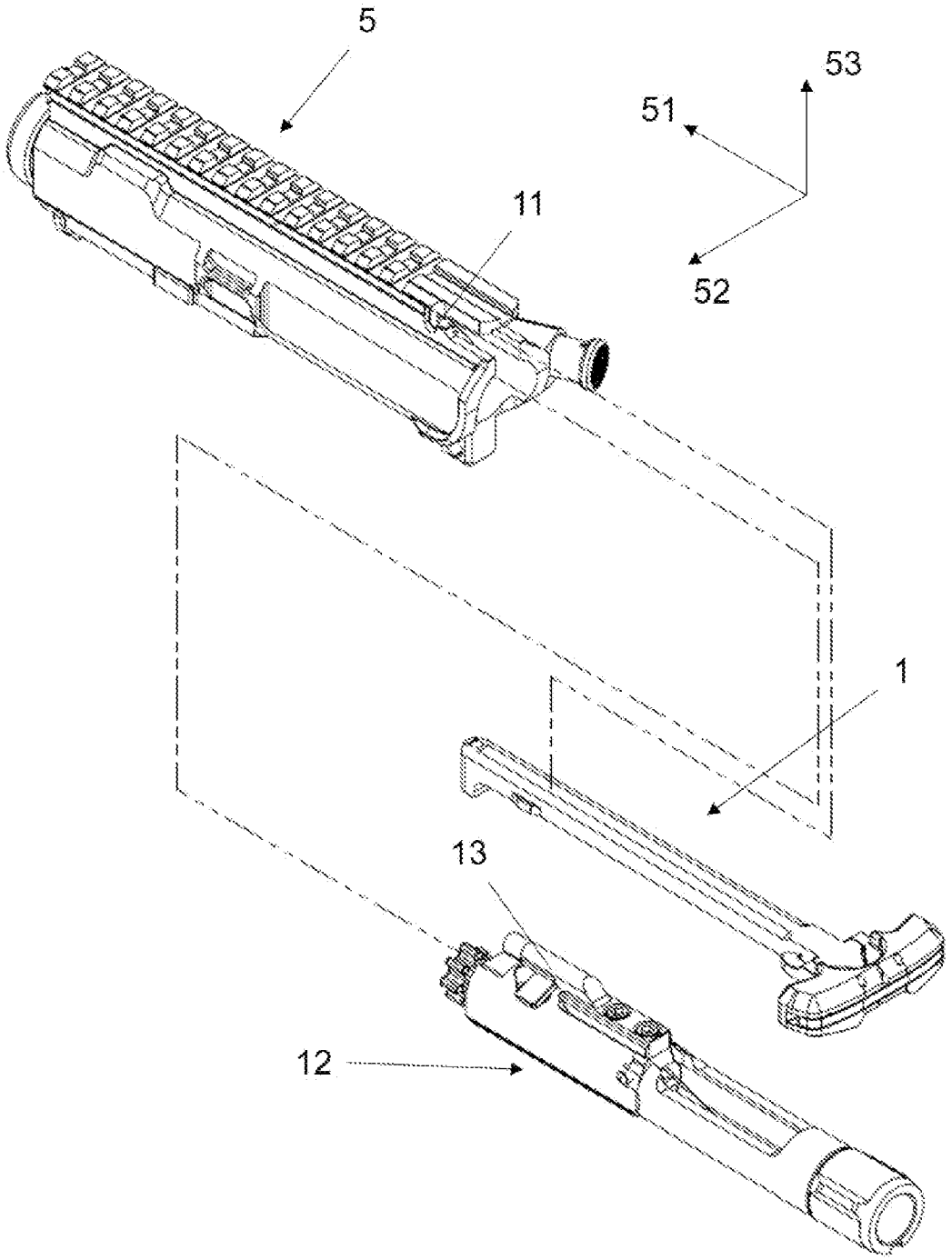
FIG. 1 depicts an illustrative charging handle according to the present disclosure with the parts of the weapon in which it is used shown in a perspective exploded view.
Figure 2:
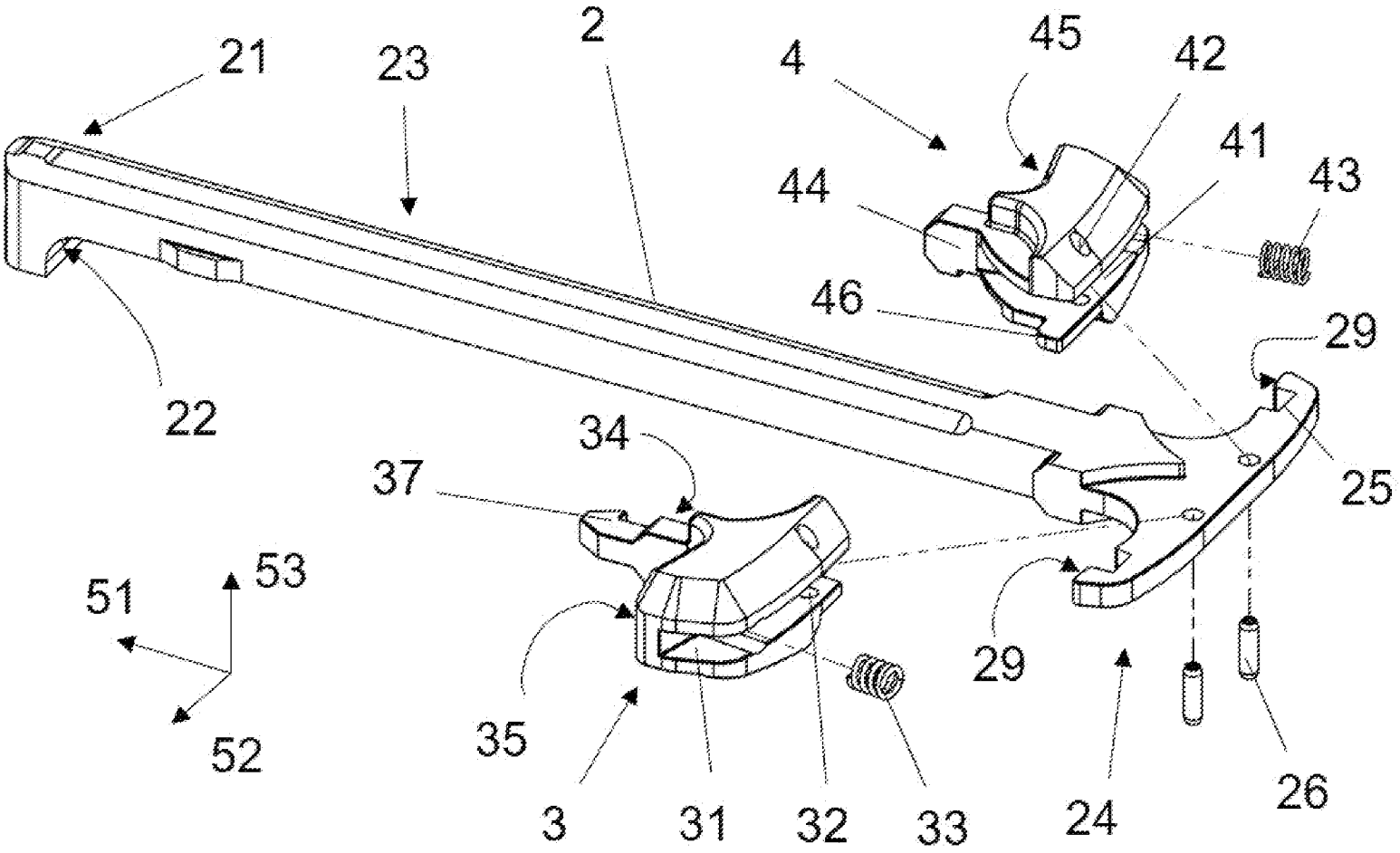
FIG. 2 depicts the charging handle of FIG. 1 in a perspective exploded view.

FIG. 1 shows the installation situation of a charging handle for an AR-15-type rifle. As for some previous charging handles, the charging handle of FIG. 1 is also configured to grip the bolt carrier 12 in the area of the gas absorption (or gas key) 13 when starting and pulling it backwards when loading manually. This movement takes place against the force of the closing spring (not shown), which moves the bolt carrier 12 forward after releasing the charging handle 1, whereby a new cartridge is inserted from the magazine into the chamber of the barrel and the closing head locks. This loading procedure is well known to the person skilled in the art, which is why only the installation situation of the charging handle 1 and the bolt carrier 12 in the upper housing 5 is shown in FIG. 1. The dashed lines illustrate schematically the uptake of the charging handle 1 and the bolt carrier 12 in the upper housing 5 of a rifle of the AR-15 type. In order to lock the charging handle 1 on the housing 5 after the shot has been fired and to minimize the risk of loosening or even "running along" with every shot, all such charging handles have a locking device, which is particularly often designed as a latch 37 (FIG. 2). This latch 37 is intended for engagement in a housing recess provided for this purpose, the "latch arrest" 11 (or latch), and usually has the shape of a pawl or a hook (also designated 37).

FIG. 2 shows a schematic exploded view of the charging handle 1 of FIG. 1, which has an integral (one-piece or firmly connected) shaft 2 designed as the central element. The shaft 2 has a front portion 21 at its front end, following in the opposite direction to the barrel direction, a center portion 23 and an end portion 24 laterally widened to the center portion in both transverse directions 52. At front portion 21, an extension in the downward direction, i.e. opposite direction 53, is formed with an opening 22 for the gas key 13.

The center portion 23 of the charging handle 1 has a longitudinal groove on its underside (FIG. 4A), which ensures a guided transport of the gases backwards against the barrel direction 51 to a gas outlet 27 in the event of any gas escaping from the bolt carrier 12. This gas outlet 27 is visible on the underside of the charging handle 1 as an arcuate recess, especially in FIGS. 3B and 4A. The arched shape ensures that the gas can escape forward away from the operator's face.

As shown in FIG. 2, two handles 3,4 (a left, active, handle 3 and a right, passive, handle 4) are attached to the end portion 24 by means of a pin or pins 26, or the like, so that they can pivot about axes disposed parallel to the vertical axis 53: an active handle only because it has the locking hook and, when actuated, deflects it in the "left" 52 direction and the charging handle 1 can be pulled back.

The handles 3,4 have groove-like recesses 31, 41 which are provided at the rear and which are at least substantially complementary in shape to the two side arms of the end portion 24. Thus, the handles 3,4 can be put on or put over the end portion 24 relatively easily and fixed with pins 26. The handles 3, 4 have an inner contour, which is shaped in such a way that in the installation position the distance of the back towards the end portion 24 increases to the outside, i.e. in transverse direction 52.

Figure 6:
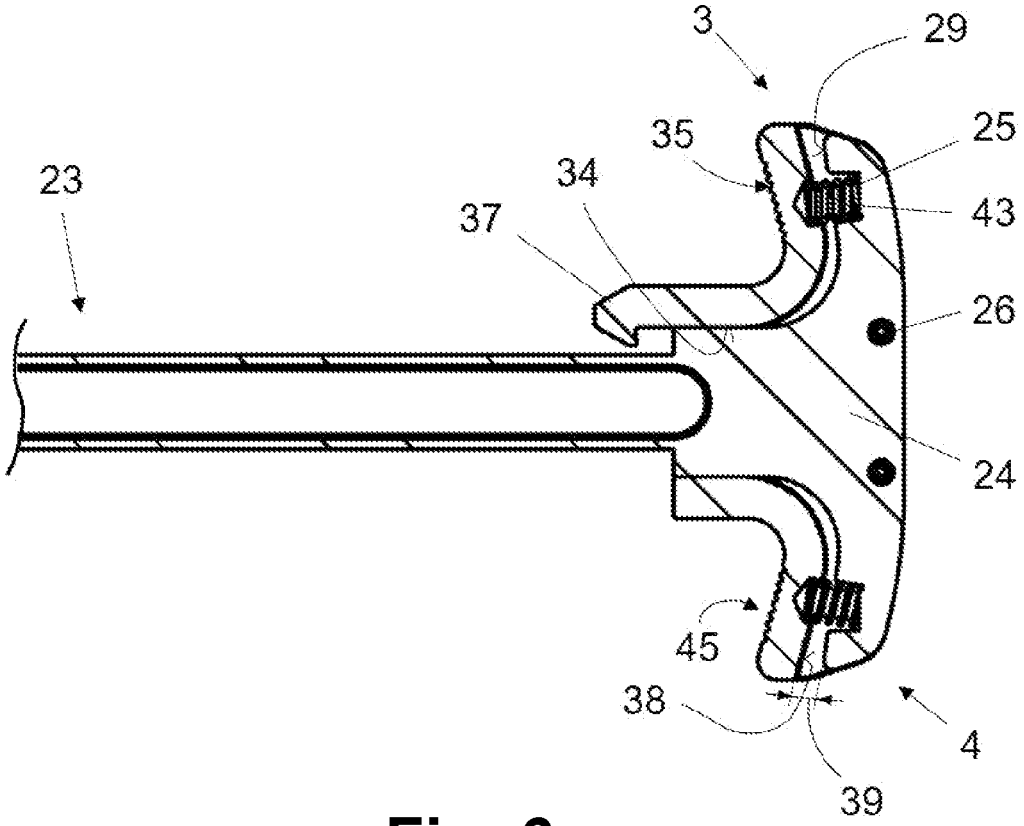
FIG. 6 depicts a horizontal cross-section view of the charging handle of FIG. 1, viewed from beneath the charging handle.

This configuration is particularly evident in FIG. 6. In other words, when viewed from above or below through the section plane along the line VI-VI of FIG. 4A, the recess 31,41 for receiving the end portion has an increasingly widening cross-section in the "left" or "right" direction 52. The grip travel distance 39, very clearly visible in FIG. 4 in conjunction with FIG. 6, is—when viewed in the rest position—designed to widen outwards. The course of the internal stop surfaces 38, 48 in FIG. 6 is shown as an arc, but can also be linear or even stepped, whereby it should be noted that they are substantially complementary in shape to the end portion 24 and in particular to the support faces 29. This means that when at least one handle 3, 4 is actuated, the stop surface 38, 48 will come into contact with the support surfaces 29, as will be explained below.

The handles 3, 4 partially take springs 33, 43, which are supported at the end portion 24 in the provided spring recesses 25. In the rest position, both grips 3, 4 are pretensioned forward in barrel direction 52 and a swivel movement backwards is made possible. FIG. 2 also shows that the right handle 4 has a contact surface 44 facing the shaft 2. This contact surface is designed analogously on handle 3 as a contact surface 34 and prevents the grips 3, 4 from "overshooting" forward and inward in the direction of the center portion 23 of the shaft 2 when the charging handle 1 is moved forward, either manually or by pretensioning the springs 33, 43. These contact surfaces 34, 44 thus form a kind of stop, up to which the grips 3, 4 can be pretensioned forward.

Figures 3A, 3B:
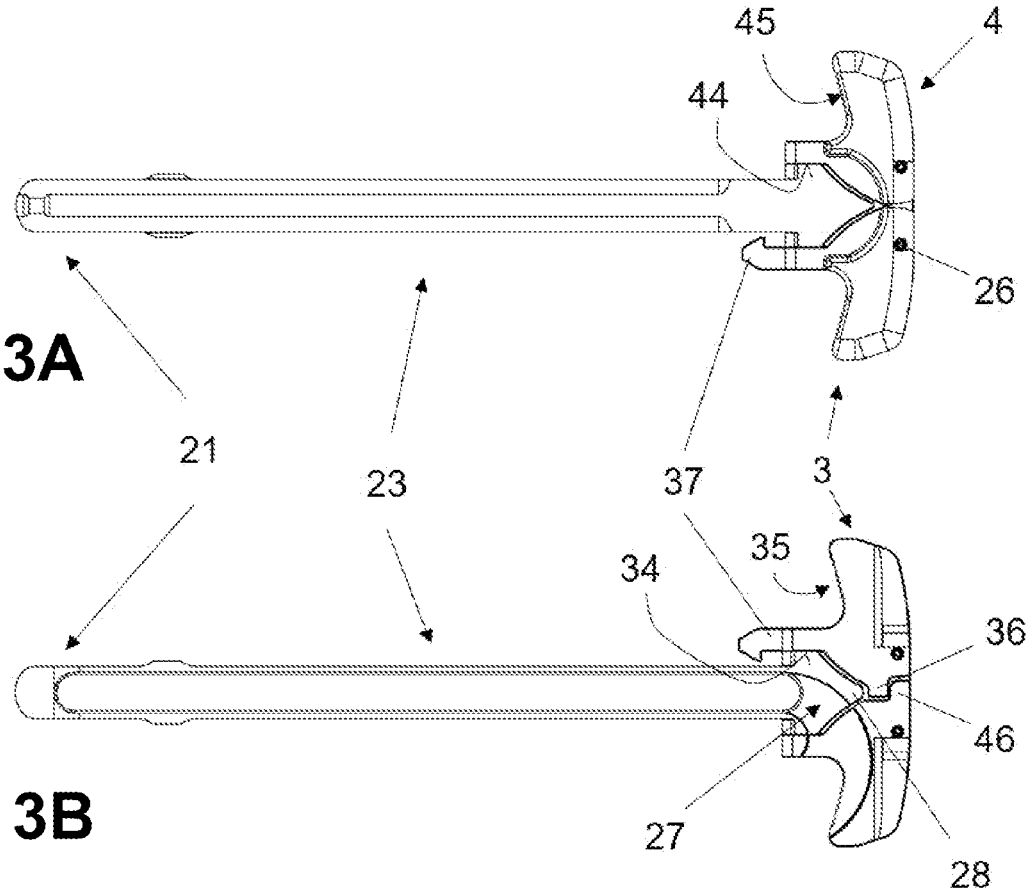
FIGS. 3A and 3B depict a top view and a bottom view, respectively, of the charging handle of FIG. 1.
Figure 4A:
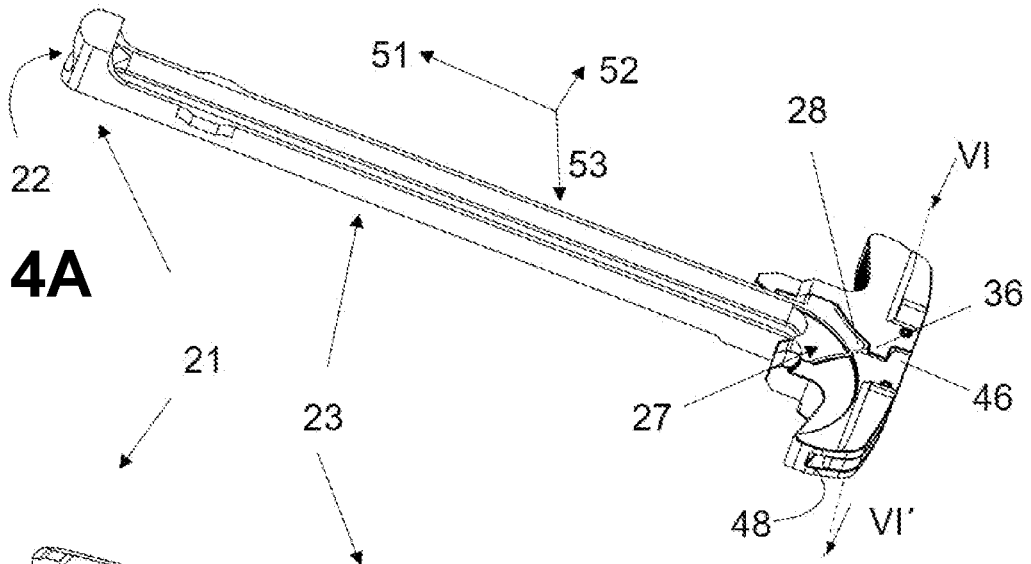
FIGS. 4A-4C depict various perspective views of the charging handle of FIG. 1.

FIGS. 3A and 3B show the handles 3, 4 in rest position, once in top view, once in bottom view; the hook 37 on the active handle 3 can be seen as well as the adjustment of the contours of the handles 3, 4 to the contours of the end portion 24.

As already mentioned, normally the pins 26 (or spring pins, locking pins or the like), which take over the fixation and rotation of the handles 3, 4, are very heavily loaded when the charging handle 1 is operated manually as intended. According to the present disclosure, the force is applied when one or both handles 3, 4 are actuated by gripping and pulling the grip surfaces 35, 45 via internal stop surfaces 38, 48 of the handles which come into contact with support surfaces 29 of end portion 24. The force is thus transferred directly to the shaft 2, which increases the rigidity of the system and significantly relieves the pin or pins 26. It is the "internal" stop surface, because it is covered both at the top and at the bottom, which protects it against dirt and minimizes the risk of jamming.

Figure 4B:
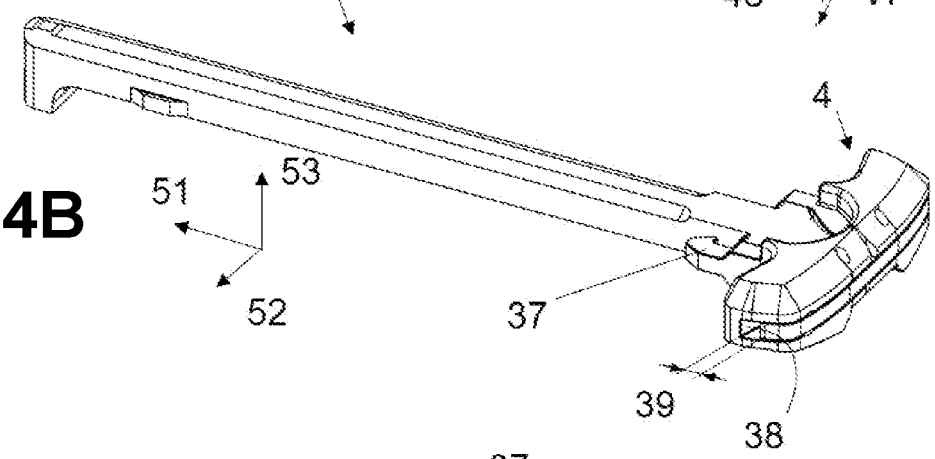
Figure 4C:
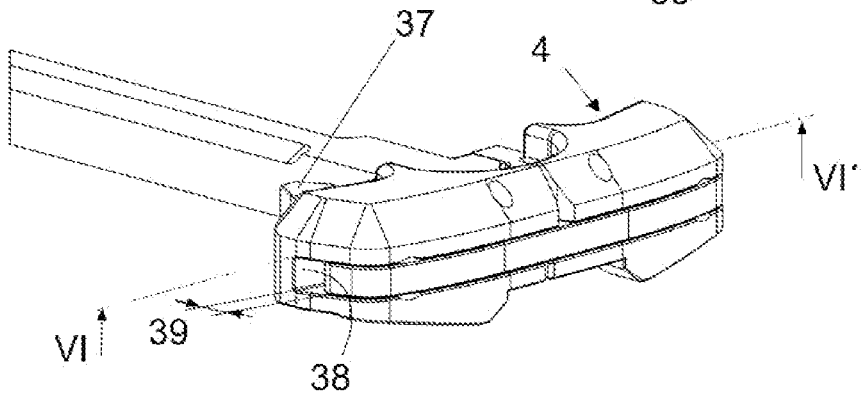

The overview of FIGS. 4B and 4C shows that when one of the handles 3, 4 is actuated by rotating, a distance between the surfaces referred to as a handle path 39 (handle path 49 of second handle not indicated in drawing but, of course, existing) must be overcome and then the load is transferred by supporting the internal stop surfaces 38 and/or 48 on the respective support surfaces 29 (see FIG. 6). This measure creates a "two-point support", i.e. at pin 26 and at least one contact point between support 29 and stop surfaces 38, 48, which increases stability. This connection can also be very easily seen in FIG. 6, where a sectional view is shown on the level of line VI-VI in FIGS. 4A and 4C "upward."

In an ideal case, when at least one handle 3, 4 is actuated, a flat support of the support surfaces 38, 48 is achieved at the end portion 24, whereby the pin(s) 26 only assume a kind of guidance. The force is therefore primarily not introduced via pin(s) 26, but through the comparatively large contact area as described above, which significantly relieves the load on pin(s) 26.

For operation when using the "passive" (right) handle 4 it must be stated: the transmission of the force or movement when actuating the right handle 4 on the hook 37 to release it, is effected via an actuator 46, clearly visible in FIG. 2, which engages the active handle 3 on the back of a counterpart of the actuator 36 and thus also deflects the left handle 3. Referring to FIG. 5B, a bottom view shows this deflection of both handles when using the right handle 4 with the contact between the two actuators 46 and 36.

Figure 5A:
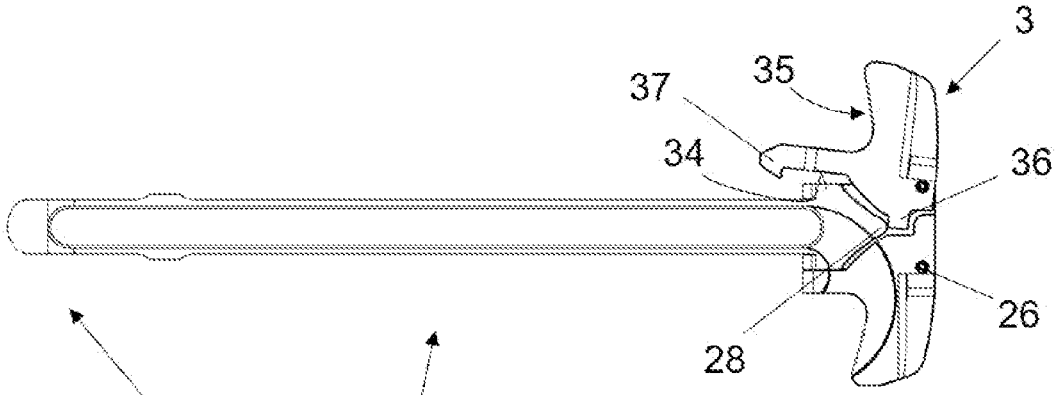
FIGS. 5A and 5B depict bottom views of the charging handle of FIG. 1, during use.
Figure 5B:
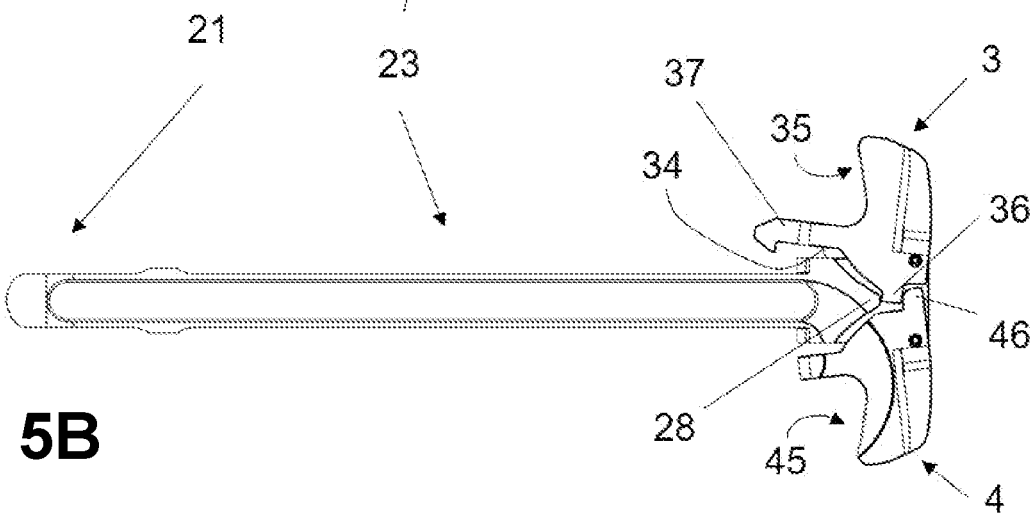

FIGS. 5A and 5B also show that the shaft has a shaft stop 28 on its underside. The shape of the shaft stop is substantially determined by the radii of the handles 3, 4 with respect to the axes of the pins 26 in this area and thus has arcuate recesses in the transverse direction 52. One preferred embodiment of the invention provides that the shaft stop 28 serves as an abutment for the passive actuator 36 (and thus indirectly also for the actuator 46 in the case of operation) when one or both handles 3,4 are actuated, whereby, on the one hand, a limit position for the pivoting is precisely defined and, on the other hand, a third bearing point is formed opposite the contact region of the respective internal stop surface 38, 48 with the support surface 29. This drastically reduces the shear stress on the pins, their support in the end portion 24 of the shaft 2 and the bearing for them in the respective handle 3, 4 and in certain embodiments, can almost completely remove any such stress. The fact that the respective contact surfaces and the pins have to meet specific tolerances creates no problems for the person skilled in the art, given the knowledge of the invention and the pretensioning with the springs, which minimizes the risk of slag, rattling and vibration.

In one example, the disclosed charging handle is configured for an existing gas-powered rifle, for example an AR-15-type rifle or an M4-type carbine, with a housing 5, the charging handle 1 having a shaft 2 with a front portion 21, a center portion 23 and an end portion 24, the front portion 21 extending into the region of a gas opening 13 of a bolt carrier 12 of the carbine and a lateral widening of the shaft 2 is provided at the end portion 24 in the transverse direction 51 for receiving an active handle 3 and a passive handle 4, which are each rotatably mounted at the widening by means of a pin 26, wherein the active handle 3 is formed integrally, preferably in one piece, with a latch 37, and designed such that it can be rotated between two positions, the latch 37 in a first fixing position cooperating with a latch arrest 11 of the housing 5 of the carbine and fixing the charging handle 1 with respect to the housing 5, and in a second release position not cooperating with the latch arrest 11 and releasing the charging handle with respect to the housing 5, the passive handle 4 being designed in such a way that it is to be brought into operative connection with the active handle 3, both handles 3, 4 being forced into the position by at least one spring 33, 43 that corresponds to the fixing position, characterized in that the release position of the first handle is defined by a support surface 29 at the widening of the end portion 24, against which an internal stop surface 38 of the active handle 3 lies in the release position. The desired relief of the pin 26 is thus achieved with only a few, robust components. Damaging stresses on the joints or pins 26 as a result of violent movements, such as tearing back the charging handle 1 when in use, can thus be efficiently avoided, whereby the number of components is comparatively low.

In another example, the charging handle of the present disclosure can be characterized in that the support surface 29 lies in a plane substantially parallel to the normal direction 53. This means that the force is transmitted as directly as possible when using the charging handle without introducing an additional torque around the transverse axis.

In another example, the charging handle of the present disclosure can be characterized in that the internal stop surface 38 in the release position lies in a plane substantially parallel to the normal direction 53. This results in a flat contact with the support surface during use without punctual stress.

In another example, the charging handle of the present disclosure can be further characterized in that the support surface 29 is at a greater distance from the central plane of the weapon than the pin 26. Since the handle is gripped externally, the force is transmitted without large deflection and the pin is further relieved.

In another example, the charging handle of the present disclosure can be further characterized in that at the end portion 24 a shaft stop 28 is provided for a counter face of the active grip 3, which is arranged closer to the center plane of the weapon than the pin 26. This creates a further contact surface for force transmission.

In another example, a charging handle of the latter type can be further characterized in that, in the release position of the first handle 3, it contacts both the support surface 29 and the stop. Thus, the pin 26 is largely, ideally completely, relieved during use.

In another example, a further-developed charging handle of the present disclosure can be characterized in that the passive handle 4 is integrally formed with an actuator 46 arranged behind a passive actuator 36 integrally formed with the active handle 3, and in that the two actuators are arranged closer to the center plane of the weapon than the pins 26, thus providing a simple and very robust transmission of the torque necessary for unlocking to the active handle when the passive handle is used.

In another example, a charging handle of the latter type can be further characterized in that the counter face for the shaft stop 28 is formed on the front face of the passive actuator 36. Thus, in case of use, the active handle is completely relieved by the passive handle after unlocking; in the case of the passive handle, its pin is also relieved by its contact surfaces with the end portion.

In another example, a further developed charging handle of the present disclosure can be characterized in that each of the handles 3, 4 has on its rear side a groove 31 that is configured to receive end portion 31, into which the lateral widening of the shaft 2 projects, and that the pins 26 are arranged in this region. This reduces tilting moments about the transverse axis 52 and protects the arrangement as a whole against the penetration of dirt; in the technical sense, the flat groove preferably lies in a plane normal to the vertical axis 53.

In another example, the charging handle of the present disclosure can be further characterized in that a spring 33, 43 is provided for each handle 3, 4, in that these springs are compression springs, preferably coil springs, and in that their axis runs parallel to the barrel direction 51 with a deviation of not more than 10°, preferably not more than 5°. This makes it possible to use the most robust type of spring; the arrangement in barrel direction 51 means that no additional moments occur; pre-tensioning the springs minimizes the risk of rattling or slagging of the handles.

In another example, a charging handle of the latter type can be characterized in that for accepting each of the springs 33, 43 recesses are formed in the walls of the groove 31 for receiving the end portion and a recess in the contour of the lateral widening of the shaft 2. This is how the springs are secured against loss without additional components.

In another example, a further developed charging handle of the disclosure can be characterized in that a gas opening 22 is provided at the front portion 21, which gas opening 22 opens into a longitudinal groove at the underside of the shaft 2 facing the barrel, which in turn opens into a gas outlet 27 pointing at least in the transverse direction 52 and preferably at least obliquely forward at the end portion 24. In this way, the gas can be discharged harmlessly when the gas is discharged, but can still be discharged away from the user.

In another example, a charging handle of the present disclosure can be further characterized in that the grips 3, 4 in their front region facing the shaft 2 each have a contact surface 34, 44 which, under the action of the springs 33, 43, are in contact with the associated side surface of the shaft 2 and thus prevent further rotation. This configuration clearly defines a rest position for the handles without additional components, and which do not rattle due to the pretension of the springs. Moments can be derived here during the "forward assist".

In another example, a charging handle of the latter type can be characterized in that the rotation of the handles 3, 4 between the position on contact of the contact surfaces 34, 44 and the position on contact of the support surfaces 29 on the outer contour of the handles defines the handle path 39.

This means, conversely, that the desired length of the handle path 39 can be achieved by the appropriate arrangement of the said surfaces.

In another example, a charging handle further developed by the fact that the axes of the pins 26 run parallel to the normal direction 53. This is beneficial for production and use.

All designs disclosed herein for the active handle 3, especially for the contact surfaces, also apply mutatis mutandis to the passive handle 4.

In another example, the charging handle of the present disclosure can be further characterized in that the narrow surfaces of each handle 3, 4 facing each other in the recess 31 for receiving the end portion, on the one hand, and the bottom of the recess 31 for the end portion including the support surface 29, on the other hand, contact each other flat in the rest position in the region in front of the pin 26 and in the release position in the region laterally in the region, which is at a greater distance from the central plane of the weapon than the pin 26. On the one hand, this results in an enlargement of the support surface 29 and, on the other hand, in an additional protection against overshooting.

Exemplary Embodiments

This section describes additional aspects and features of the disclosed charging handle, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. A charging handle for an existing gas-powered rifle, in particular an AR-15-type rifle or an M4-type carbine, with a housing (5), the charging handle (1) to be operated on both sides having a shaft (2) with a front portion (21), a center portion (23) and an end portion (24), the front portion (21) extending into the region of a gas opening (13) of a bolt carrier (12) of the carbine, and a widening of the shaft (2) on both sides in the transverse direction (52) for receiving an active handle (3) and a passive handle (4) being provided at the end portion (24), which are each rotatable mounted on the widening by means of a pin (26), wherein the active handle (3) is formed integrally, preferably in one piece, with a latch (37) and designed such that it can be rotated between two positions, the latch (37) in a first fixing position cooperating with a latch arrest (11) of the housing (5) of the carbine and fixing the charging handle (1) with respect to the housing (5), and in a second release position not cooperating with the latch arrest (11) and releasing the charging handle with respect to the housing (5), the passive handle (4) being designed in such way that it is to be brought into operative connection with the active handle (3), both handles (3, 4) being forced into the position which corresponds to the fixing position by at least one spring (33, 43), wherein the release position of the first active handle (3) is defined by a support surface (29) at the widening of the end portion (24), against which an internal stop surface (38) of the active handle (3) lies in the release position, characterized in that the support surface (29) is at a greater distance from the central plane of the weapon than the pin (26) and a shaft stop (28) for a counter face of the active handle (3) is provided at the end portion (24), which shaft stop is arranged closer to the center plane of the weapon than the pin (26), and in the release position of the first handle (3), the latter contacts both the support surface (29) and the stop (28).

A2. The charging handle according to paragraph A1, characterized in that the support surface (29) lies in a plane substantially parallel to the normal direction (53).

A3. The charging handle according to paragraph A1 or A2, characterized in that the internal stop surface (38) in the release position lies in a plane substantially parallel to the normal direction (53).

A4. the charging handle according to any of the preceding paragraphs, characterized in that the passive handle (4) is formed in one piece with an actuator (46), which is arranged behind a passive actuator (36) formed in one piece with the active handle (3), and in that the two actuators are arranged closer to the center plane of the weapon than the pins (26).

A5. the charging handle according to paragraph A4, characterized in that the counter face for the shaft stop (28) is formed on the front of the passive actuator (36).

A6. The charging handle according to any of the preceding paragraphs, characterized in that each of the handles (3, 4) has on its rear side a groove, which has an uptake for end portion (31) into which the lateral widening of the shaft (2) projects, and in that the pins (26) are arranged in this region.

A7. The charging handle according to any of the preceding paragraphs, characterized in that a spring (33, 43) is provided for each handle (3, 4), in that these springs are compression springs, preferably coil springs, and in that their axis runs parallel to the barrel direction (51) with a deviation of not more than 10°, preferably not more than 5°.

A8. The charging handle according to paragraphs A6 and A7, characterized in that for the uptake of each of the springs (33, 43) recesses (31, 41) are formed in the walls of the recess for the end portion and a spring recess (25) in the contour of the lateral widening of the shaft (2).

A9. The charging handle according to any of the preceding paragraphs, characterized in that a gas opening (22) is provided at the front portion (21), which gas opening (22) opens on the underside of the shaft (2) facing the barrel into a longitudinal groove, which in turn opens at the end portion (24) into a gas outlet (27) pointing at least in the transverse direction (52) and preferably at least obliquely forward.

A10. The charging handle according to any of the preceding paragraphs, characterized in that the handles (3, 4) each have in their front region facing the shaft (2) a contact surface (34, 44) which, under the action of the springs (33, 43), are in contact with the associated side surface of the shaft (2) and thus prevent further rotation.

A11. The charging handle according to paragraph A10, characterized in that the rotation of the handles (3, 4) between the position on contact of the contact surfaces (34, 44) and the position on contact of the support surfaces (29) on the outer contour of the handles defines the handle path (39).

A12. The charging handle according to any of the preceding paragraphs, characterized in that the contact surfaces of the actuators (46, 36) between the two handles (3, 4) are designed in such a way that, when the passive handle (4) is actuated, a rolling-sliding relative movement occurs between them, and in that, when the active handle (3) is actuated, the distance between them is greater than in the rest position. (see FIGS. 5A, 5B).

A13. The charging handle according to paragraph A1, characterized in that the release position of the second, passive handle (4) is defined by a support surface (29) at the widening of the end portion (24), against which an internal stop surface (48) of the passive handle (4) lies in the release position.

A14. The charging handle according to paragraph A13, characterized in that the support surface (29) lies in a normal plane to the barrel direction (51).

A15. The charging handle according to paragraph A13 or A14, characterized in that the internal stop surface (48) in the release position lies in a normal plane to the barrel direction (51).

A16. The charging handle according to any of paragraphs A13 to A16, characterized in that the support surface (29) is at a greater distance from the center plane of the weapon than the pin (26).

A17. The charging handle according to claim A7, characterized in that narrow surfaces of each handle (3, 4) facing each other in the uptake for end portion (31), on the one hand, and the bottom of the uptake for end portion (31) including the support surfaces (29), on the other hand, contact each other flat in the rest position in the region in front of the pin (26) and in the release position in the region laterally in the region, which is at a greater distance from the central plane of the weapon than the pin (26).

Advantages, Features, Benefits

The charging handles of the present disclosure provide several advantages over known solutions for charging handles for firearms.

The handles 3 and 4 of the disclosed charging handles can be "fully" actuated from the front, allowing good force introduction and reliable actuation even in stressful situations.

The handles 3 and 4 of the disclosed charging handles can each be operated individually, or together, and in all cases the release of the latch 37 is affected without any further action.

Due to the internal pretensioning with springs 33, 43, contamination of the charging handle is unlikely, and "rattling" of the charging handle components is efficiently reduced.

The rugged elegance of the charging handle design, including its small number of components, permits the production of the charging handles to be more cost-effective, as well as enhancing operational reliability.

The contact surfaces 34, 44 of the disclosed charging handles serve to prevent an "overshoot to the inside" and thus prevent possible jamming at the frame of the weapon.

During use of the disclosed charging handles, the transmission of the force from "right" when using the right handle 4 takes place via its actuator 46 to the "passive actuator 36." An "overshoot" is prevented by the shaft stop 28, which also makes it possible to introduce the actuating force without overloading the pins.

The handles 3, 4 of the disclosed charging handles support themselves internally after overcoming a handle path 39 at the end portion 24; this causes a support to be formed, which, especially in the presence of the shaft stop 28, relieves the bearing at the pins 26 and relieves this itself and allows marking e.g. with gloves or the like on one or both sides (handles 3, 4), without filigree or delicate components being prone to failure.

It should be noted that in the description and claims, reference to a "lower area" of an object means the lower half and in particular the lower quarter of the total height, "lowest area" the lowest quarter and in particular an even smaller part; while "center area" means the middle third of the total height (width–length). All of this information has its common meaning, applied to the intended position of the object under consideration, unless otherwise indicated.

In the description and the claims "substantially" means a deviation of up to 10% of the stated value, if it is physically possible, both downwards and upwards, otherwise only in the meaningful direction, for degrees (angle and temperature)±10° are meant.

All quantities and percentages, in particular those used to delimit the invention, are to be understood with a tolerance of ±10%, unless they concern the specific examples; for example: 11% means: from 9.9% to 12.1%. In the case of designations as in "a solvent:" the word "a" is not to be regarded as a numerical word, but as an indefinite article or as a pronoun, unless the context indicates otherwise.

The term "combination" or "combinations" means, unless otherwise indicated, all types of combinations, from two of the relevant components to a variety or all of such components, the terms "containing," "having," and "including" are to be considered non-limiting and open-ended.

The features and variants indicated in the individual embodiments and examples may be freely combined with those of the other examples and embodiments and, in particular, used to identify the invention in the claims without necessarily taking along the other details of the respective embodiment or example.

Although the present charging handle has been shown and described with reference to the foregoing operational principles and preferred embodiments, it will be apparent to those skilled in the art that various changes in form and detail may be made without departing from the spirit and scope of the present disclosure. The present invention is intended to embrace all such alternatives, modifications and variances that fall within the scope of the appended claims.

| Reference Numerals | |
|---|---|
| 1 | Charging handle |
| 11 | Latch arrest |
| 12 | Bolt carrier |
| 13 | Gas key |
| 2 | Shaft |
| 21 | Front portion |
| 22 | Gas key opening |
| 23 | Center portion |
| 24 | End portion |
| 25 | Spring recess |
| 26 | Pin |
| 27 | Gas outlet |
| 28 | Shaft stop |
| 29 | Support surface |
| 3 | First active handle ("left") |
| 31 | Recess for receiving end portion |
| 32 | Pin opening |
| 33 | Biasing means, spring |
| 34 | Contact surface |
| 35 | Grip surface |
| 36 | Passive actuator |
| 37 | Latch |
| 38 | Internal stop surface |
| 39 | Grip travel distance |
| 4 | Second (passive) grip ("right") (second handle) |
| 41 | Recess for receiving end portion |
| 42 | Pin opening |
| 43 | Biasing means, spring |
| 44 | Contact surface |
| 45 | Grip surface |
| 46 | Actuator |
| 48 | Internal stop surface |
| 49 | Grip travel distance |
| 5 | "Upper" housing |
| 51 | Barrel direction |
| 52 | Transverse direction left (normal direction left) |
| 53 | Normal direction up (normal up) |

What is claimed is:

1. A charging handle for a firearm, where the firearm has a housing that includes a latch arrest, and a bolt carrier that includes a gas opening, the charging handle comprising:

a shaft having a front portion, a center portion and an end portion;

an active handle; and a passive handle; wherein the front portion of the shaft extends into a region of the gas opening of the bolt carrier of the firearm;

the end portion of the shaft is widened on both sides in a transverse direction to receive the active handle and the passive handle;

each of the active handle and the passive handle are rotatably mounted on a widened end portion of the shaft by means of a pin;

the active handle includes an integrally-formed latch, and is configured so that the active handle can be rotated between a first fixing position and a second release position;

wherein when the active handle is in the first fixing position the latch cooperates with the latch arrest of the firearm housing to fix the charging handle with respect to the firearm housing; and when the active handle is in the second release position the latch does not cooperate with the latch arrest of the firearm housing, an internal stop surface of the active handle abuts a support surface at the widening of the end portion of the shaft; and the charging handle is free to be pulled back with respect to the firearm housing;

the passive handle is configured so as to be brought into an operative connection with the active handle;

wherein both handles are urged into the first fixing position of the active handle by at least one spring;

provided that the support surface is disposed at a greater distance from a central plane of the firearm than the pin, and a shaft stop for a counter face of the active handle is provided at the end portion of the shaft, the shaft stop being disposed closer to the center plane of the firearm than the pin, and when the active handle is in the second release position, the active handle contacts both the support surface and the shaft stop.

2. The charging handle of claim 1, wherein the charging handle can be operated from either side of the firearm.

3. The charging handle of claim 1, wherein the firearm is a gas-operated rifle.

4. The charging handle of claim 1, wherein the firearm is an AR-15 type rifle or an M4-type rifle.

5. The charging handle of claim 1, wherein the support surface lies in a plane substantially parallel to the normal direction.

6. The charging handle of claim 1, wherein when the active handle is in the second release position, the internal stop surface of the active handle lies in a plane that is substantially parallel to the normal direction.

7. The charging handle of claim 1, wherein the passive handle is formed in one piece with an actuator, the active handle is formed in one piece with a passive actuator, and the actuator and the passive actuator are arranged closer to the center plane of the firearm than the pins.

8. The charging handle of claim 7, wherein the counter face for the shaft stop is formed on a front of the passive actuator.

9. The charging handle of claim 7, wherein each of the actuator for the active handle and the passive actuator further include a contact surface disposed between the active handle and the passive handle, the contact surfaces being configured so that when the passive handle is actuated a rolling-sliding relative movement occurs between the actuators, and when the active handle is actuated, a distance between the actuators is greater than a distance between the actuators when the active handle and the passive handle are in the first fixing position.

10. The charging handle of claim 1, wherein each of the active handle and the passive handle include a groove on a rear side of the respective handle, each groove having a recess at its end portion into which the lateral widening of the shaft projects, and the pins are arranged in this region.

11. The charging handle of claim 10 wherein the recess at the end portion of the groove on the rear side of each of the active handle and the passive handle includes a depression configured to receive an end of one of the springs, and a corresponding spring recess is formed in a contour of the lateral widening of the shaft to receive the other end of the spring.

12. The charging handle of claim 10, wherein a narrow surface of each of the active handle and the passive handle opposite one another in the recess configured to accept the end portion of the shaft, and a bottom of the end portion recess including the support surfaces on the other hand, when the handles are in the first fixing position, contact each other in a area in front of the pin, and when the handles are in the second release position, contact each other in an area to the side that is at a greater distance from a center plane of the firearm than the pin.

13. The charging handle of claim 1, wherein each of the active handle and the passive handle are urged into their first fixing position by a compression spring; and each spring has a spring axis that runs parallel to a barrel direction of the firearm with a deviation of not more than 10°.

14. The charging handle of claim 13, wherein each compression spring is a coil spring, and a spring axis of each spring runs parallel to the barrel direction of the firearm with a deviation of not more than 5°.

15. The charging handle of claim 1, wherein the gas opening is provided at the front portion of the shaft, such that the gas opening opens on an underside of the shaft facing a barrel of the firearm into a longitudinal groove, which in turn opens at the end portion into a gas outlet pointing at least in a transverse direction.

16. The charging handle of claim 15, wherein the longitudinal groove opens at the end portion of the shaft into a gas outlet that points at least obliquely forward.

17. The charging handle of claim 1, wherein the active handle and the passive handle each have a front region that faces the shaft, and each front region includes a contact surface that, under action of the springs, is in contact with an associated side surface of the shaft in order to prevent further rotation of the handle.

18. The charging handle of claim 17, wherein each of the active handle and the passive handle rotate along a handle path between a position in which the handle contacts the contact surface, and a position in which an outer contour of the handle contacts the support surface.

19. The charging handle of claim 1, wherein when the passive handle is in the second release position, an internal stop surface of the passive handle contacts the support surface at the widening of the end portion of the shaft.

20. The charging handle of claim 19, wherein the support surface lies in a plane that is normal to a barrel direction of the firearm.

21. The charging handle of claim 19, wherein when the passive handle is in the second release position the internal stop surface lies in a plane that is normal to a barrel direction of the firearm.

22. The charging handle of claim 19, wherein the support surface is at a greater distance from the center plane of the firearm than the pin.

* * * * *